United States Patent [19]

Johnson

[11] Patent Number: 4,949,405

[45] Date of Patent: Aug. 21, 1990

[54] CUSPIDOR CONVERTOR

[76] Inventor: William J. Johnson, 1445 Sedalia Dr., Flower Mound, Tex. 75028

[21] Appl. No.: 288,766

[22] Filed: Dec. 22, 1988

[51] Int. Cl.[5] ..... A61J 19/00

[52] U.S. Cl. ..... 4/258; 4/283; 4/284; 4/260

[58] Field of Search ..... 4/283, 258, 259, 260, 4/270, 274, 284; 141/299

[56] References Cited

U.S. PATENT DOCUMENTS

| | | | |
|---|---|---|---|
| 199,541 | 1/1878 | Heath | 4/258 |
| 279,739 | 6/1883 | Gifford | 4/299 |
| 317,039 | 5/1885 | Strait | 4/258 |
| 445,086 | 1/1891 | Scheller | 4/258 |
| 550,361 | 11/1895 | Alley | 4/283 |
| 676,924 | 6/1901 | Steiger, Jr. | 4/283 |
| 879,314 | 2/1908 | Peter | 4/284 |
| 956,407 | 4/1910 | Orszag | 4/283 |
| 964,472 | 7/1910 | Johnson | 4/283 |
| 1,065,511 | 6/1913 | Edwards | 4/279 |
| 1,245,013 | 10/1917 | Nowakowski | 4/283 |
| 2,126,701 | 8/1938 | Hamilton | 4/258 |
| 2,218,002 | 10/1940 | Hamilton | 4/258 |
| 2,440,783 | 5/1948 | Peart | 4/283 X |
| 4,162,547 | 7/1979 | Jenkins | 4/259 |
| 4,503,572 | 3/1985 | Dawson | 4/258 |

*Primary Examiner*—Henry K. Artis
*Attorney, Agent, or Firm*—W. Kirk McCord

[57] ABSTRACT

Apparatus for adapting containers, such as 12 and 16 ounce beverage cans and bottles, for use as a cuspidor. The conveter is comprised of a housing open at the top and bottom with an inverted frusto-conical member tapering downwardly and inwardly from a top edge of the housing to a predetermined position therebelow. The conical member has a bottom aperture which communicates with the top opening. A baffle member is disposed beneath the conical member inside the housing for dividing the housing into top and bottom portions. The baffle member has a central aperture extending therethrough which is substantially in registration with the bottom aperture of the conical member to define a central passageway. The baffle member includes a tapered portion which is adapted for being inserted into the open mouths of different sized containers, such as standard beverage bottles, to direct material introduced into the housing via the top opening into the container. The bottom part of the housing includes means for engaging the top rim of a container, such as a standard beverage can, to hold the container in position within the housing for receiving waste material, such as spittle. The outside of the housing includes an outwardly extending portion and a vertical portion beneath the outwardly extending portion, the interior surfaces of which define a shoulder for engaging a top surface of the container rim to limit the upward movement thereof. A plurality of nubs project inwardly from an inner wall of the housing to engage a lower surface of the rim to limit the downward movement thereof.

14 Claims, 3 Drawing Sheets

CUSPIDOR CONVERTOR

FIELD OF THE INVENTION

This invention relates generally to cuspidors and particularly to a device for converting a common container into a cuspidor.

BACKGROUND OF THE INVENTION

Cuspidors, also known as spittoons, are used for disposal of waste fluid, such as spitted tobacco waste from chewing tobacco. A tobacco chewer has a need to periodically expectorate the tobacco waste, but he is often unable to find a suitable receptacle for receiving such waste. It is inconvenient and impractical for a tobacco user to carry around with him a suitable receptacle for the disposition of tobacco waste.

DESCRIPTION OF THE PRIOR ART

According to prior practice, the earliest spittoons were large and bulky receptacles, such as the brass spittoon which is depicted in western movies to have been a fixture in every saloon in the West. In addition to being heavy, such receptacles were unsanitary and unpleasant to clean. Furthermore, if the receptacles were tipped over, the contents thereof would spill out of the receptacle.

The advent of lighter weight, inexpensive manufacturing materials, such as plastics and papers, fostered the development of disposable spittoons, which provided a more sanitary method of disposing of spittle. Although these disposable spittoons represented an improvement over the heavy brass spittoons, disposable spittoons were not always available to the tobacco chewer and the problem of spillage continued to occur.

Numerous patents have been issued on various types of prior art cuspidors. For example, U.S. Pat. Nos. 550,361; 676,924; 964,472; 1,065,511; and 2,440,783 teach various types of cuspidors, the object of which is to solve or attempt to solve the aforementioned spillage problem. Other types of cuspidors are illustrated in U.S. Pat. Nos. 879,314 (cuspidor having a reversible bowl and a valve connection whereby the opening in the cover is automatically closed after being opened by a user's foot); 2,126,701 (sputum cup comprised of a disposable cup and a flanged lid for engaging the top part of the cup); 2,218,002 (sputum cup having a disposable receptacle with a flanged lid); 4,162,547 (a pocket cuspidor comprised of a three-part receptacle with a disposable inner bag); and 4,503,572 (disposable receptacle with a flanged lid tapering toward a central opening in the receptacle).

One problem associated with prior art cuspidors, including disposable cuspidors, is that the special configuration of the cuspidor receptacle makes it expensive to replace. Furthermore, the tobacco user must still carry the disposable receptacle around with him until it has been used and disposed of because cuspidors are not readily available. Consequently, tobacco users often use common containers, such as beverage cans and the like, in which to expectorate. Such common containers are typically not adapted for receiving spittle, primarily because the openings therein are not of sufficient size and proper shape.

OBJECTS OF THE INVENTION

It is therefore the principal object of the present invention to provide a device for adapting a variety of containers for use as a cuspidor.

It is another object to provide a device for attachment to a standard beverage container in order to convert the beverage container into a cuspidor.

Yet another object of the invention is to provide a relatively inexpensive cuspidor.

Still another object of the invention is to provide a cuspidor in which a first portion thereof is reusable and a second portion thereof containing the spittle is disposable.

A further object of the invention is to provide a cuspidor which is easily and conveniently handled and transported.

Still a further object of the invention is to provide a cuspidor having an aesthetically pleasing appearance.

SUMMARY OF THE INVENTION

These and other objects are accomplished in accordance with the present invention wherein an apparatus is provided for adapting standard sized, readily available containers for use as cuspidors. In one aspect of the invention a container having a rim member, such as a standard sized 12 ounce beverage can, is adapted for use as a cuspidor. The adapting apparatus is comprised of a housing having top and bottom openings and a passageway communicating therebetween, means disposed within the housing for directing the material introduced therein through the top opening into the passageway toward the bottom opening and for substantially preventing material from escaping back through the top opening, and means positioned adjacent to the bottom opening for engaging upper and lower surfaces of the rim member for retaining at least a portion of the container in a substantially fixed position within the housing, such that the container will receive the material directed into the passageway toward the bottom opening.

In one embodiment, the means for engaging the rim member includes shoulder means disposed in the housing for engaging a top surface of the rim member to limit the upward movement thereof and nub means projecting inwardly from an inner wall of the housing for engaging a lower surface of the rim member to limit the downward movement thereof. The nub means is preferably comprised of a plurality of nubs spaced at predetermined intervals around the inner wall of the housing and projecting inwardly therefrom.

In another embodiment the means for directing the material includes an inverted conical member tapering inwardly and downwardly from a top edge of the housing. The conical member has an aperture in a bottom part thereof communicating with the top opening. In yet another embodiment a baffle member is disposed below the conical member in the housing and is attached to the inner wall thereof for dividing the housing into top and bottom portions. The baffle member has an aperture extending therethrough, which is substantially in registration with the aperture in the conical member for allowing the material to be directed toward the bottom opening in the housing.

In another aspect of the invention means is provided for being inserted at least partially into an open mouth container for directing material into the container. The means for being inserted into the open mouth container includes a tapered portion adapted for insertion into container mouths of different diameters. The depth of insertion of the tapered portion is dependent upon the size of the container mouth.

In one embodiment, a baffle member is provided having a first conical portion tapering downwardly and inwardly from an inner wall of the housing, a first substantially cylindrical portion extending downwardly from the first conical portion, a second conical portion tapering downwardly and inwardly from the first cylindrical portion and a second cylindrical portion extending downwardly from the second conical portion. The outside diameter of the first cylindrical portion is substantially the same as the inside diameter of a large-mouthed beverage bottle to provide a cork-like fit when the first cylindrical portion is inserted therein. The outside diameter of the second cylindrical portion is substantially the same as the inside diameter of a regular-mouthed beverage bottle to provide a cork-like fit when the second cylindrical portion is inserted therein.

In another embodiment an interior baffle member is provided having a first conical portion tapering inwardly and downwardly from an inner wall of the housing and a second conical portion tapering inwardly and downwardly therefrom. A top part of the second conical portion has an outside diameter which is greater than the inside diameter of the largest-mouthed standard beverage bottle and a bottom part of the second conical portion has an outside diameter which is less than the inside diameter of the smallest-mouthed standard beverage bottle.

The apparatus according to the present invention is adapted for attachment to open mouth containers, such as standard beverage bottles having different sized mouths, and to containers having rim members, such as standard beverage cans, such that material introduced into the apparatus is directed into the container, substantially without spillage. A disposable cuspidor is therefore provided using readily available containers.

BRIEF DESCRIPTION OF THE DRAWINGS

Other objects and advantages of the invention will be apparent from the Detailed Description and claims when read in conjunction with the accompanying drawings wherein:

DETAILED DESCRIPTION OF THE PREFERRED EMBODIMENT

In the description which follows like parts are marked throughout the Specification and Drawings, respectively. The drawings are not necessarily to scale and in some instances proportions have been exaggerated in order to more clearly depict certain features of the invention.

Figure 1:
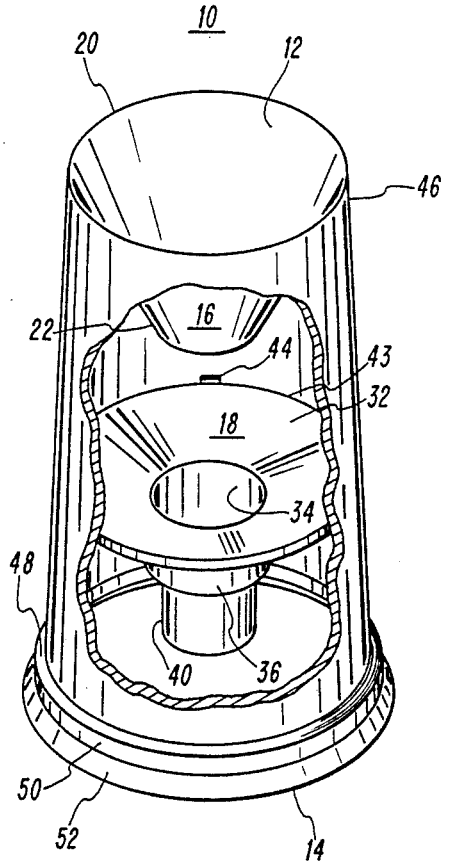
FIG. 1 is a perspective view of a first embodiment of a cuspidor converter in accordance with the present invention, in which a portion of the outer wall is broken away.
Figure 2:
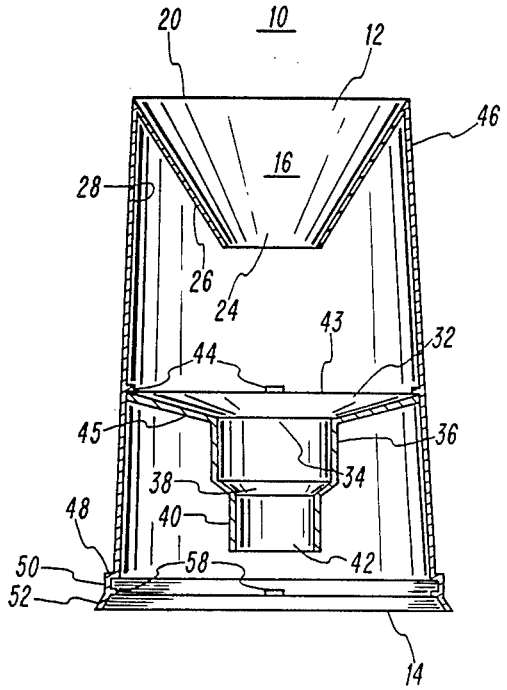
FIG. 2 is a sectional view of the cuspidor converter of FIG. 1, taken vertically through the center thereof.
Figure 3:
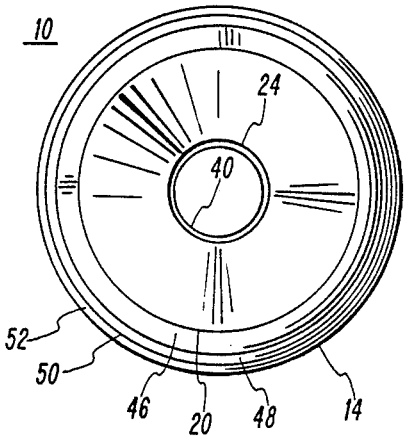
FIG. 3 is a top plan view of the cuspidor converter of FIG. 1.

Referring to FIGS. 1, 2 and 3, a cuspidor converter 10 has respective top and bottom openings 12 and 14 with a passageway communicating therebetween and first and second interior baffles 16 and 18, respectively. First baffle 16 is in the shape of an inverted, truncated cone, the upper edge of which defines an upper edge 20 of converter 10. First baffle 16 narrows from a diameter of approximately 1 13/16 inches at upper edge 20 to a diameter of approximately 9/16 inch at lower edge 22 to define a first intermediate aperture 24 at lower edge 22. The diameter of aperture 24 is maintained sufficiently small so that any matter passing therethrough can also pass through the top opening of a host container to which converter 10 is joined. First baffle 16 is tapered downwardly and inwardly to a depth of approximately one inch below upper edge 20, such that all matter entering converter 10 through top opening 12 is directed downwardly and toward the center of converter 10 through aperture 24. As best seen in FIG. 2, outer wall 26 of first baffle 16 cooperates with inner wall 28 of converter 10 to trap spittle and other waste matter therebetween, thereby preventing or substantially reducing spillage from converter 10 through top opening 12 when converter 10 is tipped over.

Second baffle 18 is disposed beneath first baffle 16 and is comprised of an inverted first conical portion 32 having a second intermediate aperture 34 substantially in registration with first intermediate aperture 24, a first substantially cylindrical portion 36 below first conical portion 32, followed by an inverted second conical portion 38 and a second substantially cylindrical portion 40. Cylindrical portion 40 has a third intermediate aperture 42 at a bottom edge thereof. A central passageway communicates between second and third intermediate apertures 34 and 42.

Upper surface 43 of first conical portion 32 is located at approximately the mid-point of the height of converter 10 and is joined to inner wall 28 by means of a continuous weld or by glue to provide a relatively tight seal separating the upper and lower portions of converter 10. A plurality of nubs 44 are spaced at predetermined intervals around inner wall 28 for locating second baffle 18. Respective undersurfaces of nubs 44 are in abutting relationship with upper surface 43 of first conical portion 32. Upper surface 43 is relatively flat and lies substantially in a plane which is substantially parallel to the plane in which upper edge 20 and top opening 12 lie. Wall 45 of first conical portion 32 tapers sharply inward and slightly downward from inner wall 28, terminating at first cylindrical portion 36.

First cylindrical portion 36 extends downwardly from first conical portion 32 approximately ¾ inch. Second conical portion 38 extends downwardly approximately ¼ inch below first cylindrical portion 36 and second cylindrical portion 40 extends approximately ¾ inch below second conical portion 38. The outside diameter of first cylindrical portion 36 is sized to allow first cylindrical portion 36 to be inserted into the mouth of a large-mouthed standard sized 12 or 16 ounce beverage bottle 47 to provide a tight, cork-like fit, as best seen in FIG. 4A. Similarly, the outside diameter of second cylindrical portion 40 is sized to allow second cylindrical portion 40 to be inserted into the mouth of a regular-mouthed standard 12 or 16 ounce beverage bottle 49 to provide a tight, cork-like fit, as best seen in FIG. 4B.

Projecting outwardly from outer wall 46 of converter 10 is a relatively flat shelf 48. A substantially vertical wall 50 extends perpendicularly downward from an outer edge of shelf 48. A bottom portion of converter 10 is defined by an outwardly tapering wall 52.

In the preferred embodiment the height of converter 10 from upper edge 20 to shelf 48 is on the order of three inches. The inside diameter of converter 10 at vertical wall 50 is slightly smaller than the smallest outside diameter of the top rim of a standard 12 ounce or 16 ounce beverage can (i.e., on the order of 2.328 inches). The material from which converter 10 is manufactured is sufficiently flexible to account for differences in the diameter of the top rim of various beverage cans and yet is rigid enough to provide a snug fit engagement therebetween to maintain a proper liquid seal.

Figure 4C:
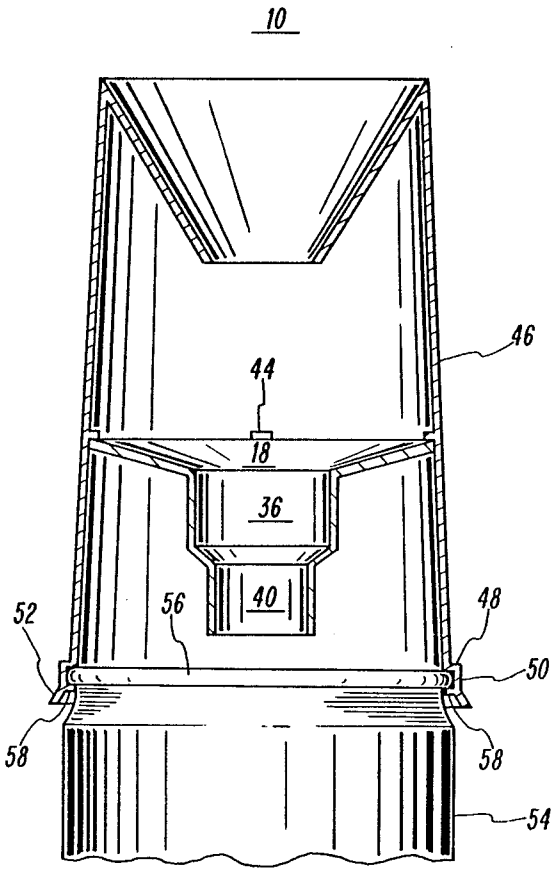
FIGS. 4A–4C are respective sectional views of the cuspidor converter of FIG. 1, illustrating the engagement between the converter and various containers to provide a cuspidor.
Figure 4B:
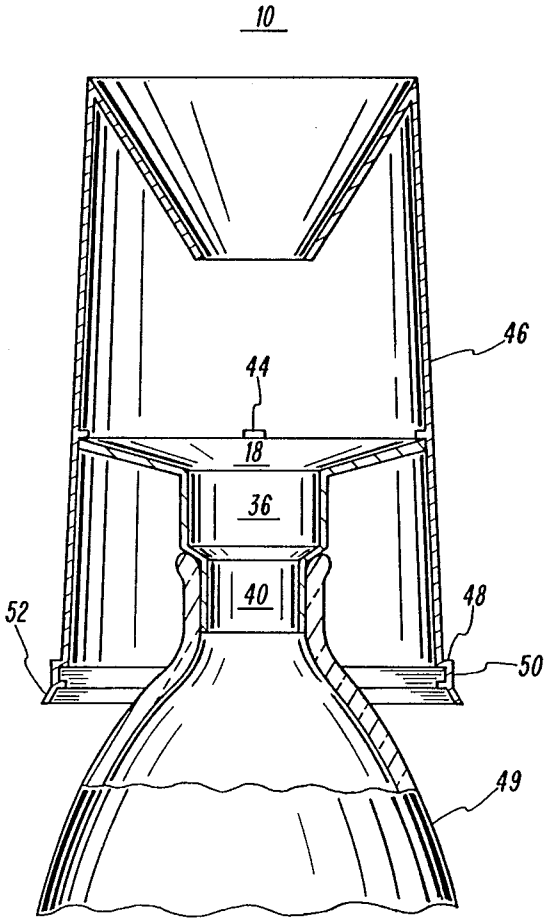
Figure 4A:
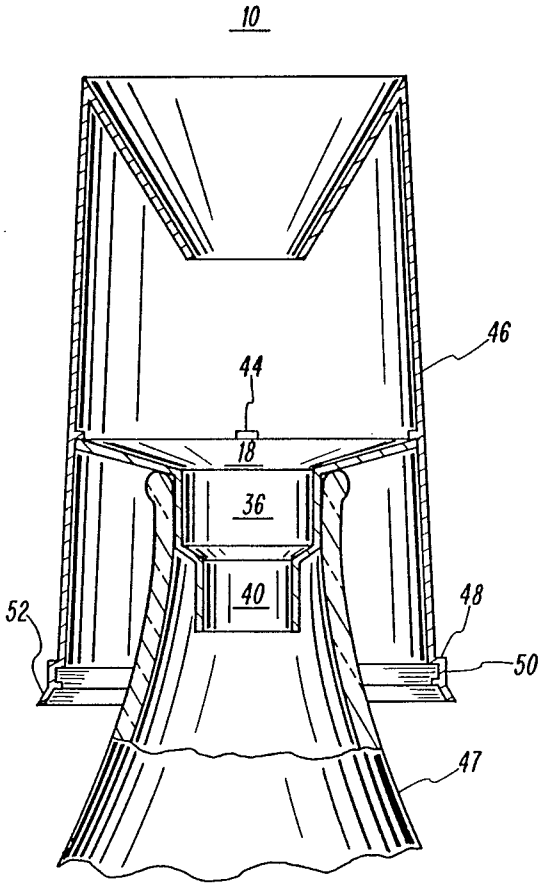

As best seen in FIG. 4C, a standard 12 ounce or 16 ounce beverage can 54 is insertable into converter 10 through bottom opening 14, such that top rim 56 of beverage can 54 engages an inner surface of shelf 48, which functions as a shoulder to prevent further upward movement of can 54. Can 54 is urged into converter 10 by the inwardly tapering inner surface of wall 52.

A plurality of nubs 58 are spaced at predetermined intervals and protrude inwardly from an inner surface of converter 10 at approximately the intersection between vertical wall 50 and tapering wall 52. Nubs 58 engage the undersurface of rim 56 to limit the downward movement of beverage can 54 and retain can 54 in position within converter 10. Each nub 58 extends inwardly approximately 0.025 inch and has a thickness in the horizontal dimension of no more than $\frac{1}{4}$ inch and a height in the vertical dimension of not more than 1/32 inch. A vertical spacing of at least 3/32 inch should be available between the top surface of each nub 58 and the interior surface of shelf 48 in order to provide adequate room for rim 56 to be seated. During insertion of can 54 into converter 10, the bottom portion of converter 10 flexes outwardly so that rim 56 can clear nubs 58. After insertion, the bottom portion closes back in, such that nubs 58 engage the undersurface of rim 56.

Figure 5:
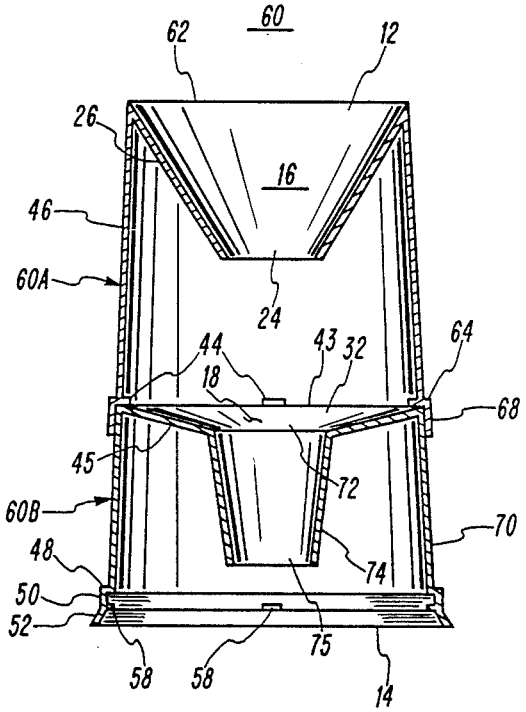
FIG. 5 is a sectional view of a second embodiment of a cuspidor converter according to the present invention, taken vertically through the center.
Figure 6:
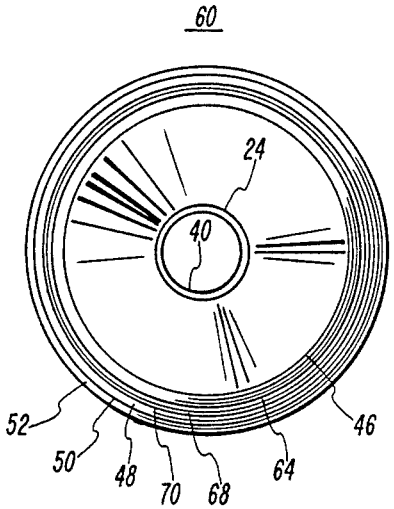
FIG. 6 is a top plan view of the cuspidor converter of FIG. 5.

Referring to FIGS. 5 and 6, an alternate embodiment of a cuspidor converter 60 is depicted. Converter 60 is comprised of an upper portion 60A and a lower portion 60B. Upper portion 60A tapers outwardly and downwardly from top edge 62 and includes a laterally extending shelf 64, which is sufficiently wide to provide an undersurface for affixing upper portion 60A to top surface 43 of interior baffle 18.

Lower wall 68 of upper portion 60A extends downwardly approximately $\frac{1}{4}$ inch below shelf 64 and slightly outwardly therefrom. The interior surface of lower wall 68 is affixed to an outer surface of wall 70 of lower portion 60B by gluing or the like to complete the joinder of upper and lower portions 60A and 60B.

Interior baffle 18 is comprised of an inverted first conical portion 72 having a central aperture therein and an inverted second conical portion 74, which is tapered gradually inwardly and downwardly from first conical portion 72 to define a funnel-shaped member. The bottom part of second conical portion 74 includes a central aperture 75, which communicates with the central aperture in first conical portion 72. The maximum diameter of second conical portion 74 is slightly greater than the inside diameter of the opening of large-mouthed standard 12 and 16 ounce beverage bottles and the minimum diameter of second conical portion 74 is slightly less than the inside diameter of regular-mouthed standard 12 and 16 ounce beverage bottles. Thus, second conical portion 74 is dimensioned to fit into various sized mouths of standard 12 and 16 ounce beverage bottles to provide a tight, cork-like fit. Except as specifically mentioned above, converter 60 is substantially the same as converter 10, previously described with reference to FIGS. 1–3.

Figure 7:
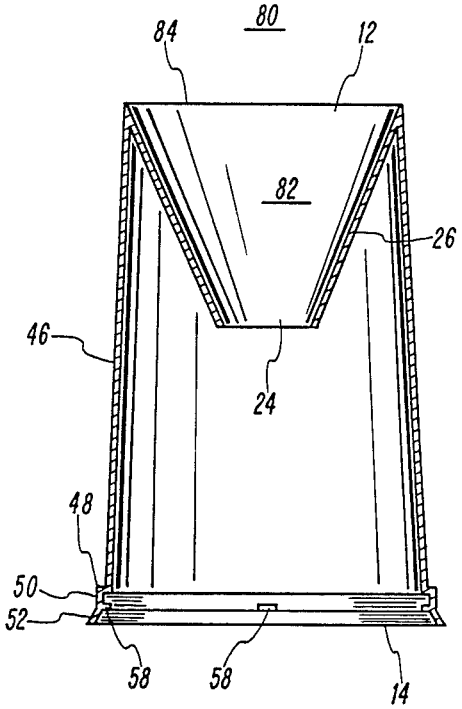
FIG. 7 is a sectional view of a third embodiment of the cuspidor converter according to the present invention, taken vertically through the center thereof.
Figure 8:
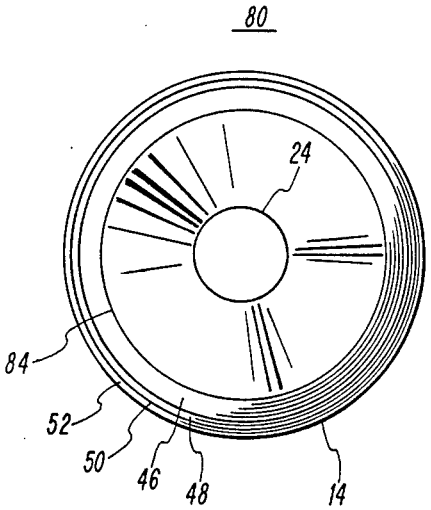
FIG. 8 is a top plan view of the cuspidor converter of FIG. 7.

Referring to FIGS. 7 and 8, yet another embodiment of a cuspidor converter 80 according to the present invention is depicted. Converter 80 is different from converters 10 and 60 previously described in that converter 80 is integrally formed as a single manufactured piece. No welding or gluing is required in order to construct converter 80. Converter 80 supports standard sized 12 and 16 ounce beverage cans. Only one baffle 82, which has an inverted frusto-conical shape, is depicted. Baffle 82 tapers inwardly and downwardly from top edge 84 of converter 80 in substantially the same manner as baffle 16, described above with reference to FIGS. 1–3. Because no other interior baffle is present, baffle 82 can be extended a greater distance downwardly into converter 80 than baffle 16 previously described. Otherwise, converter 80 is coupled to standard sized beverage cans in substantially the same manner as described above with reference to FIGS. 1–3.

The cuspidor converter according to the present invention has the advantage of adapting readily available containers, such as standard sized beverage cans and bottles, to serve as a convenient and sanitary receptacle for the disposal of spittle and other waste material. The converter can be quickly and conveniently attached to and detached from standard containers, which would otherwise probably be disposed of. The converter device can be reused in connection with other disposable containers. The interior baffle arrangement guards against spillage, which makes the converter safe, sanitary and convenient to use. The converter is preferably made of a reground biodegradable rubberized polystyrene plastic using a thermoforming process, which yields a wall thickness of approximately 0.020 inch. The thickness of the material should be such as to provide for the desired flexibility of the material without detracting from the needed structural integrity thereof.

Various embodiments of the invention have now been described in detail. Since it is obvious that changes in and additions to the above-described preferred embodiment may be made without the departing from the nature, spirit and scope of the invention, the invention is not to be limited to said details, except as set forth in the appended claims.

What is claimed is:

1. Apparatus for selectively adapting a container having an upper portion defined by inner and outer surfaces surrounding an inlet opening for use as a cuspidor, said apparatus comprising:

a housing having top and bottom openings and a passageway communicating therebetween;

means disposed within said housing for directing material introduced therein through said top opening into said passageway toward said bottom opening and into said inlet opening and for substantially preventing said material from escaping back through said top opening; and means located with respect to said bottom opening and adapted to be selectively engaged with one of said inner and outer surfaces of said upper portion whereby said container can be retained in a substantially fixed position with respect to said housing by selectively engaging either said inner or outer surface with said means, such that said container will receive at least some of the material directed into said passageway toward said bottom opening and into said container.

2. Apparatus of claim 1 wherein said means for directing said material includes an inverted conical member tapering inwardly and downwardly from a top edge of said housing, said conical member having an aperture in a bottom part thereof communicating with said top opening.

3. Apparatus of claim 2 wherein an outer wall of said conical member cooperates with an inner wall of said housing for trapping material therebetween, thereby substantially preventing material from backing out of said housing through said aperture and said top opening.

4. Apparatus of claim 2 further including a baffle member disposed below said conical member in said housing and attached to the inner wall of said housing for dividing said housing into top and bottom portions, said baffle member having an aperture extending therethrough and being substantially in registration with the aperture in said conical member for allowing said material to be directed toward said bottom opening in said housing, said baffle member for substantially preventing said material from flowing backward from the bottom portion of said housing to the top portion thereof.

5. Apparatus of claim 4 wherein said inlet opening comprises an open mouth and said means for engaging said inner surface comprises said baffle member including a tapered portion for being inserted into said open mouth of said container to provide a cork-like fit therein, said open mouth of said container for receiving the material introduced into said housing through said top opening, the depth of insertion of said tapered portion being dependent upon the diameter of the open mouth.

6. Apparatus of claim 5 wherein said baffle member is further comprised of a first conical portion tapering downwardly and inwardly from an inner wall of said housing, a first substantially cylindrical portion extending downwardly from said first conical portion, a second conical portion tapering downwardly and inwardly from said first substantially cylindrical portion and a second substantially cylindrical portion extending downwardly from said second conical portion, said first substantially cylindrical portion having an outside diameter which is substantially the same as the inside diameter of a large-mouthed beverage bottle to provide a cork-like fit when said first substantially cylindrical portion is inserted therein, said second substantially cylindrical portion having an outside diameter which is substantially the same as the inside diameter of a regular mouthed beverage bottle to provide a cork-like fit when said second substantially cylindrical portion is inserted therein.

7. Apparatus of claim 5 wherein said baffle member is further comprised of a first conical portion tapering downwardly and inwardly from the inner wall of said housing and a second conical portion tapering downwardly and inwardly below said first conical portion, a top part of said second conical portion having an outside diameter which is greater than the inside diameter of a large-mouthed beverage bottle and a bottom part of said second conical portion having an outside diameter which is less than the inside diameter of a small-mouthed beverage bottle, such that the second conical portion can be inserted into the mouths of different sized beverage bottles to provide a cork-like fit therein, the depth of insertion of said second conical portion into the bottle mouth being dependent upon the diameter of the bottle mouth.

8. Apparatus of claim 1 wherein said outer surface comprises a rim member of a container and said means for engaging said outer surface includes shoulder means disposed in said housing for engaging a top surface of said rim member to limit the upward movement thereof and nub means projecting inwardly from an inner wall of said housing for engaging a lower surface of said rim member to limit the downward movement thereof, said nub means being spaced apart vertically from said shoulder means by an amount sufficient to receive said rim member therebetween to provide a snug fit engagement.

9. Apparatus of claim 8 wherein said housing tapers downwardly and outwardly from a top edge thereof to a predetermined position adjacent to a bottom edge thereof, said housing having an outwardly extending portion at said predetermined position and a substantially vertical portion extending downwardly from an outer edge of said outwardly extending portion, respective inner surfaces of said outwardly extending portion and said vertical portion defining said shoulder means.

10. Apparatus of claim 9 further including an outwardly tapering portion and terminating at said bottom edge, said outwardly tapering portion defining an outwardly flared bottom opening for facilitating the insertion of said container into said housing through said bottom opening.

11. Apparatus of claim 8 wherein said nub means is comprised of a plurality of nubs spaced at predetermined intervals around the inner wall of the housing and projecting inwardly therefrom.

12. Apparatus for adapting a beverage can for use as a cuspidor, said can having opposed top and bottom surfaces, a cylindrical wall connecting the top and bottom surfaces, an inlet opening in a portion of the top surface and a rim member surrounding a top edge of the can, said apparatus comprising:

a housing having top and bottom openings and a passageway communicating therebetween;

means disposed within said housing for directing material introduced therein through said top opening into said passageway toward said bottom opening and into said inlet opening and for substantially preventing said material from escaping back through said top opening;

means located adjacent to said bottom opening for selectively engaging said rim member, said means including a shoulder member disposed in said housing for engaging a top part of said rim member to limit upward movement of said can within said housing and a plurality of nubs projecting inwardly from an inner wall of said housing for engaging a bottom part of said rim member to retain said can at least partially within said housing, so that at least some of the material directed into said passageway will enter said can through said inlet opening, sad nubs being spaced apart vertically from said shoulder member sufficient to receive said rim member therebetween to provide a snug-fit engagement.

13. Apparatus of claim 12 wherein said housing tapers downwardly and outwardly from the top edge thereof to a predetermined position adjacent to a bottom edge thereof, said housing having an outwardly extending portion at said predetermined position and a substantially vertical portion extending downwardly from an outer edge of said outwardly extending portion, respective inner surfaces of said outwardly extending portion and said vertical portion defining said shoulder member.

14. Apparatus of claim 13 further including an outwardly tapering portion and terminating at said bottom edge, said outwardly tapering portion defining an outwardly flared bottom opening for facilitating the insertion of said container into said housing through said bottom opening.

* * * * *